US012396548B2

(12) United States Patent
Wang

(10) Patent No.: US 12,396,548 B2
(45) Date of Patent: Aug. 26, 2025

(54) BRUSH HEAD MOUNTING STRUCTURE OF LIQUID SPRAYING BRUSH

(71) Applicant: Ningbo Shijia Cleaning Tools Co., Ltd., Zhejiang (CN)

(72) Inventor: Siwen Wang, Zhejiang (CN)

(73) Assignee: Ningbo Shijia Cleaning Tools Co., Ltd., Ningbo (CN)

( * ) Notice: Subject to any disclaimer, the term of this patent is extended or adjusted under 35 U.S.C. 154(b) by 488 days.

(21) Appl. No.: 17/831,614

(22) Filed: Jun. 3, 2022

(65) Prior Publication Data

US 2023/0232972 A1 Jul. 27, 2023

(30) Foreign Application Priority Data

Jan. 24, 2022 (CN) ..... 202220185136.4

(51) Int. Cl.

*A46B 7/04* (2006.01)
*A46B 7/02* (2006.01)
*A46B 11/00* (2006.01)
*A46B 5/00* (2006.01)

(52) U.S. Cl.

CPC ..... *A46B 11/002* (2013.01); *A46B 7/02* (2013.01); *A46B 7/04* (2013.01); *A46B 5/0095* (2013.01)

(58) Field of Classification Search

CPC ..... A46B 7/04; A46B 7/042; A46B 7/044; A46B 7/02
USPC ..... 15/176.1, 176.6; 401/270, 290
See application file for complete search history.

(56) References Cited

U.S. PATENT DOCUMENTS 730,040 A * 6/1903 McKinley ..... A46B 11/0041 401/268
6,250,833 B1 * 6/2001 Perry ..... A46B 11/0013 401/206
6,425,701 B1 * 7/2002 Jacobs ..... A46B 11/0013 401/206
7,040,830 B2 * 5/2006 Kliegman ..... A47L 17/04 401/187
2004/0265042 A1 * 12/2004 Chan ..... A47L 1/08 401/270
2005/0069375 A1 * 3/2005 Kliegman ..... A47L 17/04 401/185
2014/0311524 A1 * 10/2014 Call ..... B08B 1/14 15/104.94

(Continued)

FOREIGN PATENT DOCUMENTS

CN 209610267 U 11/2019

*Primary Examiner* — Michael D Jennings
(74) *Attorney, Agent, or Firm* — Jose Cherson Weissbrot

(57) ABSTRACT

A brush head mounting structure of a liquid spraying brush, includes a connecting base provided at the end of a handle and a mounting base provided on a brush head; the other side of the connecting base with respect to the handle is provided with a slider, one side of the mounting base adjacent to the connecting base is provided with a sliding groove in sliding fit with the slider, a limiting structure is provided between the connecting base and the mounting base, the limiting structure is capable of limiting the connecting base and the mounting base along the sliding direction perpendicular to the slider, both sides of the mounting base corresponding to the sliding groove are provided with elastic arms, the position of the mounting base corresponding to the elastic arm is provided with an avoidance space for the elastic arm to expand outwards.

5 Claims, 4 Drawing Sheets

(56) References Cited

U.S. PATENT DOCUMENTS

| | | | | |
|---|---|---|---|---|
| 2016/0113384 | A1* | 4/2016 | Olson | A46B 11/0058 15/104.94 |
| 2022/0232960 | A1* | 7/2022 | Brown | B25G 3/12 |

* cited by examiner

BRUSH HEAD MOUNTING STRUCTURE OF LIQUID SPRAYING BRUSH

TECHNICAL FIELD

The present utility model relates to the technical field of cleaning products, in particular to a brush head mounting structure of a liquid spraying brush.

BACKGROUND

When people are cleaning, they usually use a cleaning brush to brush the objects to be cleaned. In the cleaning process, a cleaning brush and cleaning liquid are usually used together. A user holds the cleaning brush in one hand and the cleaning liquid in the other, squeezes some cleaning liquid before or during cleaning, and then brushes with the cleaning brush.

As the cleaning brush and the cleaning liquid are provided separately, it is necessary not only to hold the cleaning brush by hand, but also to pour the cleaning liquid with the other hand during the cleaning process, which makes the cleaning process more troublesome. Aiming at this technical problem, Chinese patent (authorized announcement number CN209610267U) discloses a liquid spraying brush, which comprises a shell with an opening. A soft rubber part located at the opening is provided on the shell. The soft rubber part forms a liquid storage cavity with the inner wall of the shell. The shell is provided with an ejection opening communicated with the liquid storage cavity. A nozzle valve is provided in the ejection opening. The nozzle valve comprises a soft film with openable holes. The ejection opening of the shell is provided with a brush head. In order to facilitate the disassembly of the brush head from the shell, the liquid spraying brush is provided with a plug-in block at the bottom of the shell. A bump is provided on the plug-in block. A plug-in slot into which the plug-in block is plugged is provided on the brush head. An elastic block corresponding to the bump is provided in the plug-in slot. The elastic block can drive the plug-in block to move away from the plug-in slot, and the brush head is provided with a positioning fixture block for fixing the plug-in block, so that the brush head can be detachably connected to the shell. When the brush head needs to be disassembled and replaced, the positioning fixture block is pressed downwards, so that the plug-in block loses the blocking effect of the positioning fixture block, and the plug-in block can be separated from the plug-in slot under the elastic force of the elastic block. In this way, the brush head can be disassembled from the shell quickly and conveniently.

However, the above structure has the following disadvantages.

1. When disassembling the brush head, it is necessary to press the positioning fixture block first and then push the brush head out of the shell, which is inconvenient to operate.
2. Because the positioning fixture block is provided outside the plug-in slot corresponding to the brush head, when the liquid spraying brush is used, the positioning fixture block is pressed by mistake, so that the brush head is unlocked from the shell, and then the brush head falls off from the shell.

SUMMARY

The purpose of the present utility model is to provide a brush head mounting structure of a liquid spraying brush with a simple structure and convenient brush head disassembly. The elastic arm is provided in the sliding groove of the mounting base, which can prevent the positioning protrusion on the elastic arm and the groove on the slider from being unlocked due to being triggered by mistake.

The above technical purpose of the present utility model is realized by the following technical scheme: a brush head mounting structure of a liquid spraying brush, comprising a connecting base provided at the end of a handle and a mounting base provided on a brush head, wherein the other side of the connecting base with respect to the handle is provided with a slider, one side of the mounting base adjacent to the connecting base is provided with a sliding groove in sliding fit with the slider, a limiting structure is provided between the connecting base and the mounting base, the limiting structure is capable of limiting the connecting base and the mounting base along the sliding direction perpendicular to the slider, both sides of the mounting base corresponding to the sliding groove are provided with elastic arms, the position of the mounting base corresponding to the elastic arm is provided with an avoidance space for the elastic arm to expand outwards, the other side of the elastic arm with respect to the avoidance space is provided with a positioning protrusion, the slider is provided with a groove in positioning fit with the positioning protrusion, and the connecting base and the mounting base are capable of being limited along the sliding direction of the slider in such a manner that the positioning protrusion is fit with the groove.

Further, one end of the sliding groove is a closed end and the other end thereof is an open end, and a pressing part is provided on one side of the mounting base corresponding to the open end.

Further, the pressing part protrudes from the mounting base toward the side away from the closed end.

Further, after the mounting base is assembled on the connecting base, a distance L1 between an end face of the pressing part and the connecting base is greater than or equal to a distance L2 by which the positioning protrusion slides out of the groove.

Further, an interval between a limiting grooves gradually increases from the closed end to the open end, and the slider is matched with the structure of the sliding groove.

Further, the limiting structure comprises limiting blocks provided on both sides of the slider, both sides of the mounting base corresponding to the sliding groove are provided with limiting grooves in limiting fit with the limiting blocks, or both sides of the mounting base corresponding to the sliding groove are provided with limiting blocks, and both sides of the connecting base corresponding to the sliding groove are provided with limiting grooves in limiting fit with the limiting blocks.

Further, the connecting base is detachably connected to the handle.

Further, the pressing part is provided with a smooth curved surface which is convenient for fingers to push.

Further, the other side of the slider corresponding to the handle is provided with a weight-reducing groove.

To sum up, the present utility model has the following beneficial effects.

1. The mounting structure of the brush head is simple, and it is convenient to disassemble the brush head. The brush head can slide out of the connecting base only by pushing the pressing part, so that the brush head can be disassembled from the connecting base for replacement. When the brush head needs to be assembled on the connecting base, it is only necessary to insert the brush head into the connecting base along the sliding direction of the slider. The positioning protrusion on the elastic arm is matched with the groove on the slider, and the brush head is firmly assembled on the connecting base through the limiting structure.

2. By designing the pressing part, the distance L1 between the end face of the pressing part far away from the open end and the connecting base is greater than or equal to the distance L2 by which the positioning protrusion slides out of the groove, so that the end face of the pressing part is just flush with the end face of the connecting base or is still outside the connecting base when the positioning protrusion is separated from the groove. In this way, fingers will not be in contact with the sharp surface of the connecting base in the process of pushing the pressing part.
3. The elastic arm is provided in the sliding groove of the mounting base, which can prevent the positioning protrusion on the elastic arm and the groove on the slider from being unlocked due to being triggered by mistake.

In the figures: 1. Handle; 11. Liquid storage cavity; 2. Brush head; 21. Mounting base; 211. Through holes; 212. Sliding groove; 2121. Closed end; 2122. Open end; 213. Elastic arm; 2131. Positioning protrusion; 214. Avoid space; 215. Pressing part; 2151. Smooth curved surface; 216. Limiting groove; 22. Washing part; 3. Connecting base; 31. Liquid outlet; 32. Slider; 321. Groove; 322. Limiting block; 323. Weight-reducing groove.

DETAILED DESCRIPTION OF THE EMBODIMENTS

The present utility model will be further explained with reference to the attached drawings hereinafter.

Figure 1:
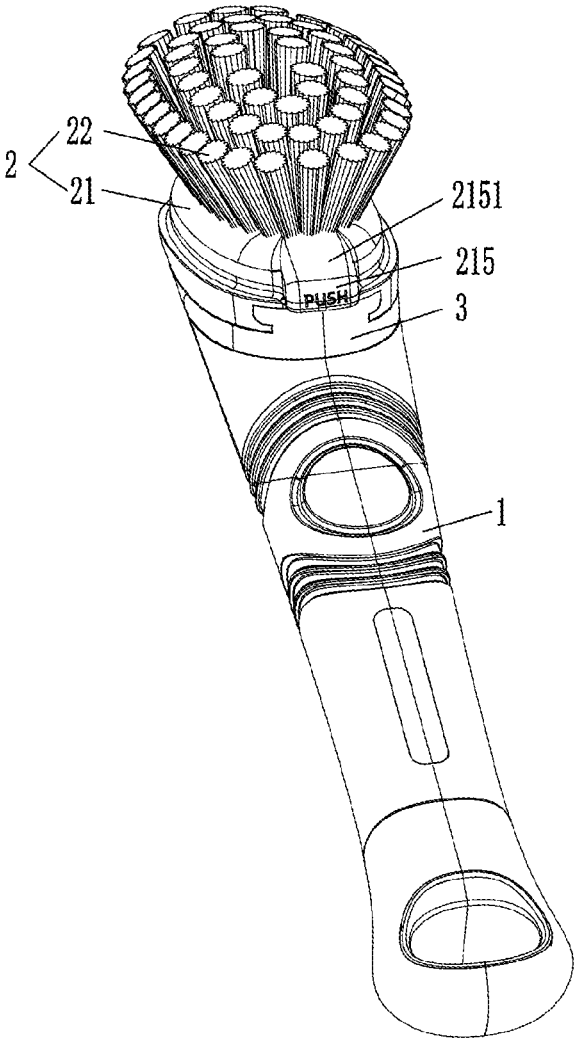
FIG. 1 is a schematic diagram of the overall structure of the present utility model.
Figure 2:
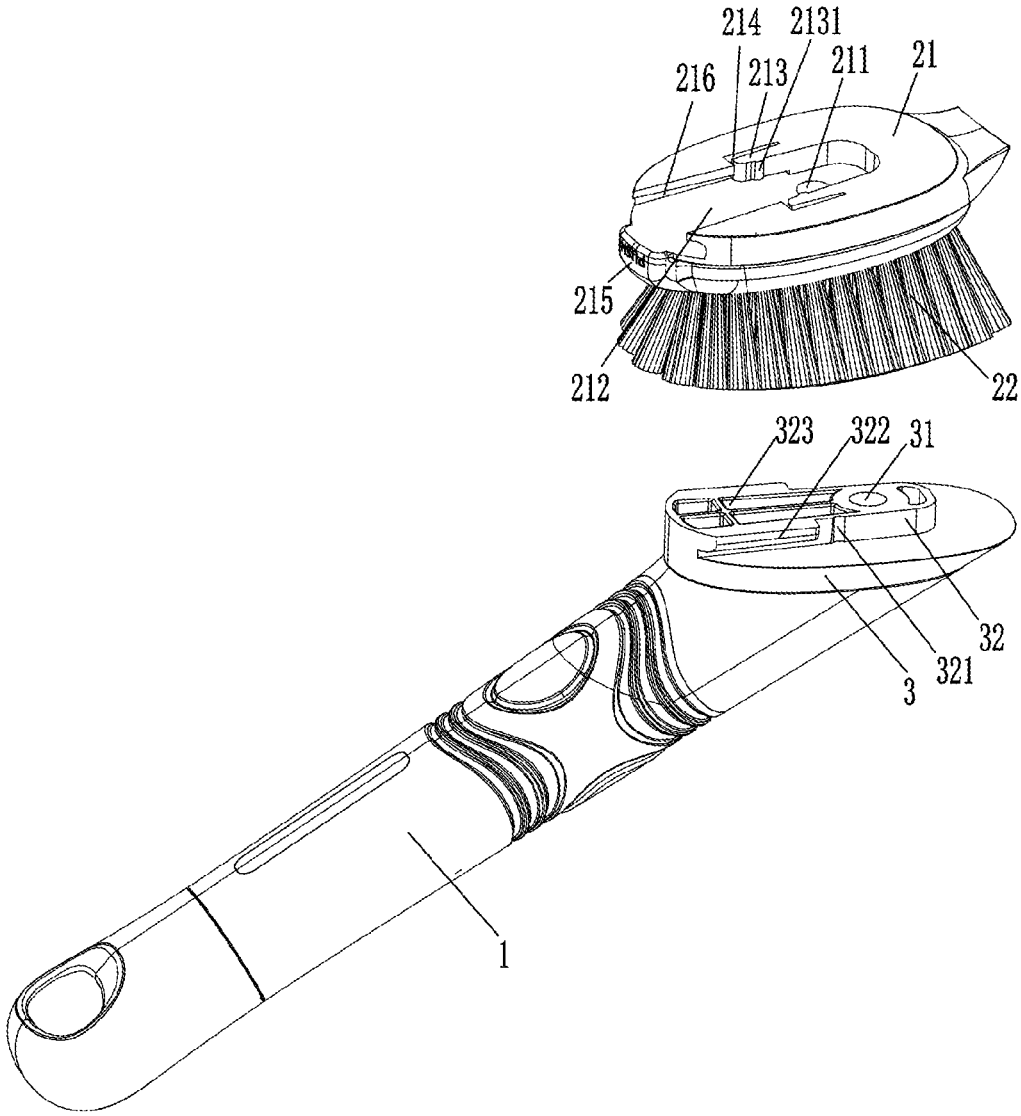
FIG. 2 is an explosion diagram of the present utility model.
Figure 3:
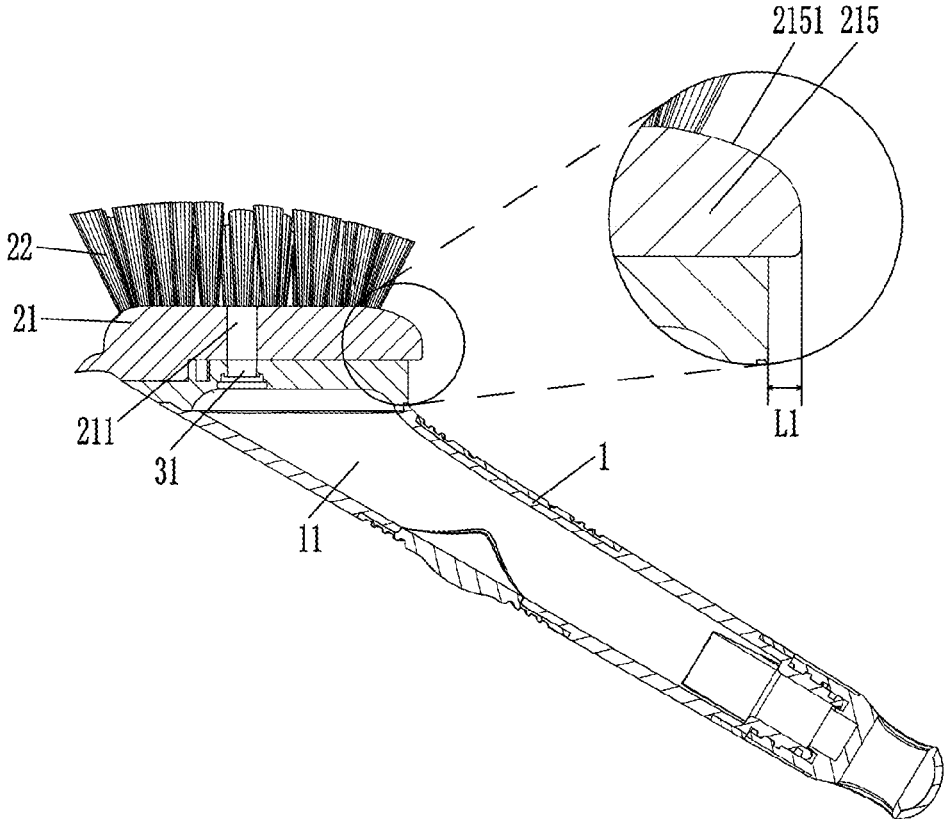
FIG. 3 is a cross-sectional diagram of the present utility model.
Figure 4:
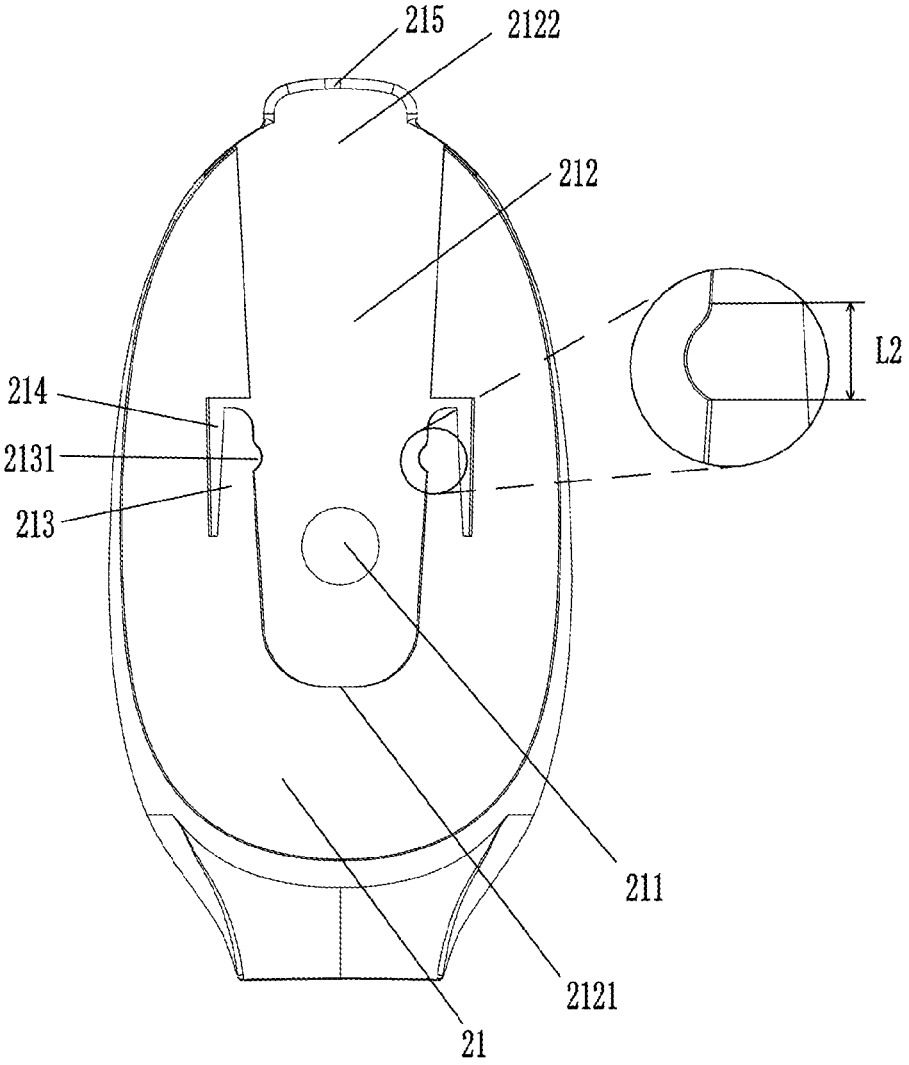
FIG. 4 is a schematic diagram of a mounting base according to the present utility model.

As shown in FIGS. 1-4, a brush head mounting structure of a liquid spraying brush comprises a connecting base 3 provided at the end of a handle 1 and a mounting base 21 provided on a brush head 2. A liquid storage cavity 11 is provided in the handle 1. A connecting base 3 for sealing the liquid storage cavity 11 is provided at one end of the handle 1 adjacent to the brush head 2. In the present utility model, the connecting base 3 is detachably connected to the handle 1, and the connecting base 3 is provided with a liquid outlet 31 communicated with the liquid storage cavity 11. The structure of the handle 1 is the prior art. For details, refer to Chinese patent (authorized announcement number CN209610267U) which discloses a liquid spraying brush. The brush head 2 comprises a mounting base 21 and a washing part 22 fixedly provided on the mounting base 21. In the present utility model, the washing part 22 is a hairbrush or a sponge scouring pad, etc. Through holes 211 communicated with the liquid outlet 31 penetrate through the mounting base 21 in the direction of the washing part 22, which constitutes the basic structure of the liquid spraying brush.

The other side of the connecting base 3 with respect to the handle 1 is provided with a slider 32. In the present utility model, the liquid outlet 31 is located in the area where the slider 32 is located, and the liquid outlet 31 penetrates through the slider 32. One side of the mounting base 21 adjacent to the connecting base 3 is provided with a sliding groove 212 in sliding fit with the slider 32, that is, the other side of the mounting base 21 with respect to the washing part 22 is provided with a sliding groove 212 in sliding fit with the slider 32. The slider 32 is matched with the sliding groove 212 for guiding, so that the mounting base 21 is conveniently inserted to the connecting base 3. Specifically, one end of the sliding groove 212 is a closed end 2121 and the other end thereof is an open end 2122. A pressing part 215 is provided on one side of the mounting base 21 corresponding to the open end 2122, and the pressing part 215 is provided with a smooth curved surface 2151 which is convenient for fingers to push.

A limiting structure is provided between the connecting base 3 and the mounting base 21. The limiting structure is capable of limiting the connecting base 3 and the mounting base 21 along the sliding direction perpendicular to the slider 32. Specifically, the limiting structure comprises limiting blocks 322 provided on both sides of the slider 32. Both sides of the mounting base 21 corresponding to the sliding groove 212 are provided with limiting grooves 216 in limiting fit the limiting blocks 322, or both sides of the mounting base 21 corresponding to the sliding groove 212 are provided with limiting blocks, and both sides of the connecting base 3 corresponding to the sliding groove 212 are provided with limiting grooves 216 in limiting fit with the limiting blocks 322, which are not shown in the structure diagram.

Both sides of the mounting base 21 corresponding to the sliding groove 212 are provided with elastic arms 213. The position of the mounting base 21 corresponding to the elastic arm 213 is provided with an avoidance space 214 for the elastic arm 213 to expand outwards. The other side of the elastic arm 213 with respect to the avoidance space 214 is provided with a positioning protrusion 2131. The slider 32 is provided with a groove 321 in positioning fit with the positioning protrusion 2131. The connecting base 3 and the mounting base 21 are capable of being limited along the sliding direction of the slider 32 in such a manner that the positioning protrusion 2131 is fit with the groove 321. The elastic arm 213 is provided in the sliding groove 212 of the mounting base 21, which can prevent the positioning protrusion 2131 on the elastic arm 213 and the groove 321 on the slider 32 from being unlocked due to being triggered by mistake.

An interval between the limiting grooves (216) gradually increases from the closed end (2121) to the open end 2122. The slider 32 is matched with the structure of the sliding groove (212), so that when the slider 32 passes through the elastic arm 213, the elastic arm 213 can be pushed to the side of the avoidance space 214. The slider 32 can smoothly enter the sliding slot 212 and abut against the closed end 2121 of the sliding slot 212. At this time, the positioning protrusion 2131 on the elastic arm 213 is clamped into the groove 321 of the slider 32 under the action of elastic force, thus playing a positioning role. The structural design of the sliding groove 212 can effectively prevent the slider 32 from being inserted into the sliding groove 212 due to the influence of the elastic arm 213.

The pressing part 215 protrudes from the mounting base 21 toward the side away from the closed end 2121. After the mounting base 21 is assembled on the connecting base 3, a distance L1 between an end face of the pressing part 215 and the connecting base 3 is greater than or equal to a distance L2 by which the positioning protrusion 2131 slides out of the groove 321. In the present utility model, the distance L1 is 2 mm-5 mm. By designing the pressing part 215, the end face of the pressing part 215 is just flush with the end face of the connecting base 3 or is still outside the connecting base 3 when the positioning protrusion 2131 is separated from the groove 321. In this way, fingers will not be in contact with the sharp surface of the connecting base 3 in the process of pushing the pressing part 215.

The other side of the slider 32 corresponding to the handle 1 is provided with a weight-reducing groove 323. The design of the weight-reducing groove 323 can reduce the material of the connecting base 3 to reduce the manufacturing cost of the connecting base 3, and at the same time, reduce the overall quality of the liquid spraying brush.

The mounting structure of the brush head is simple, and it is convenient to disassemble the brush head 2. The brush head 2 can slide out of the connecting base 3 only by pushing the pressing part 215, so that the brush head 2 can be disassembled from the connecting base 3 for replacement. When the brush head 2 needs to be assembled on the connecting base 3, it is only necessary to insert the brush head 2 into the connecting base 3 along the sliding direction of the slider 32. The positioning protrusion 2131 on the elastic arm 213 is matched with the groove 321 on the slider 32, and the brush head 2 is firmly assembled on the connecting base 3 through the limiting structure.

The above is only the preferred embodiment of the present utility model. Therefore, any equivalent changes or modifications made according to the structure, characteristics and principles described in the patent application scope of the present utility model are included in the patent application scope of the present utility model.

The invention claimed is:

1. A brush head mounting structure of a liquid spraying brush, comprising: a connecting base (3) provided at the end of a handle (1) and a mounting base (21) provided on a brush head (2), wherein the other side of the connecting base (3) with respect to the handle (1) is provided with a slider (32) having two sides, wherein one side of the two sides of the slider (32) corresponding to the handle (1) is provided with a weight-reducing groove (323), one side of the mounting base (21) adjacent to the connecting base (3) is provided with a sliding groove (212) in sliding fit with the slider (32), wherein one end of the sliding groove (212) is a closed end (2121) and the other end thereof is an open end (2122), a pressing part (215) is provided on one side of the mounting base (21) corresponding to the open end (2122), the pressing part (215) protrudes from the mounting base (21) toward the side away from the closed end (2121), wherein the disengagement of the brush head from the connecting base is based on pushing the pressing part (215) so that the brush head (2) can slide out of the connecting base (3) and thus the brush head (2) can be disassembled from the connecting base (3) for replacement, wherein the pressing part has a smooth curved surface, and the smooth curved surface is along circumferential direction of the mounting base (21), a limiting structure is provided between the connecting base (3) and the mounting base (21), the limiting structure is capable of limiting the connecting base (3) and the mounting base (21) along the sliding direction perpendicular to the slider (32), both sides of the mounting base (21) corresponding to the sliding groove (212) are provided with elastic arms (213), the position of the mounting base (21) corresponding to the elastic arm (213) is provided with an avoidance space (214) for the elastic arm (213) to expand outwards, the other side of the elastic arm (213) with respect to the avoidance space (214) is provided with a positioning protrusion (2131), the slider (32) is provided with a groove (321) in positioning fit with the positioning protrusion (2131), and the connecting base (3) and the mounting base (21) are capable of being limited along the sliding direction of the slider (32) in such a manner that the positioning protrusion (2131) is fit with the groove (321).

2. The brush head mounting structure of the liquid spraying brush according to claim 1, wherein after the mounting base (21) is assembled on the connecting base (3), the distance L1 between the end face of the pressing part (215) and the connecting base (3) is greater than or equal to the distance L2 by which the positioning protrusion (2131) slides out of the groove (321).

3. The brush head mounting structure of the liquid spraying brush according to claim 1, wherein the interval between the sliding grooves (212) gradually increases from the closed end to the open end (2122), and the slider (32) is matched with the structure of the sliding grooves (212).

4. The brush head mounting structure of the liquid spraying brush according to claim 1, wherein the limiting structure comprises limiting blocks (322) provided on each of the two sides of the slider (32), both sides of the mounting base (21) corresponding to the sliding groove (212) are provided with limiting grooves (216) in limiting fit the limiting blocks (322), or both sides of the mounting base (21) corresponding to the sliding groove (212) are provided with limiting blocks, and both sides of the connecting base (3) corresponding to the sliding groove (212) are provided with limiting grooves (216) in limiting fit with the limiting blocks (322).

5. The brush head mounting structure of the liquid spraying brush according to claim 1, wherein the connecting base (3) is detachably connected to the handle (1).

* * * * *